United States Patent [19]

Zaris

[11] 4,145,770

[45] Mar. 27, 1979

[54] FLOATING SWIMMING POOL

[76] Inventor: Louis Zaris, 107 Guarantee Trust Bldg., North Carolina & Atlantic Aves., Atlantic City, N.J. 08404

[21] Appl. No.: 831,376

[22] Filed: Sep. 8, 1977

[51] Int. Cl.[2] ..... A47K 3/00

[52] U.S. Cl. ..... 4/171; 4/172.19

[58] Field of Search ..... 4/171, 172.12, 172, 4/172.19

[56] References Cited

U.S. PATENT DOCUMENTS

| | | | |
|---|---|---|---|
| 1,777,572 | 10/1930 | Meditz | 4/171 |
| 3,026,538 | 3/1962 | Boyd et al. | 4/171 |
| 3,072,920 | 1/1963 | Yellott | 4/172.12 |
| 3,078,472 | 2/1963 | Salisbury | 4/171 |
| 3,602,925 | 9/1971 | Thompson | 4/171 |
| 3,893,443 | 7/1975 | Smith | 4/172.12 X |

FOREIGN PATENT DOCUMENTS

| | | | |
|---|---|---|---|
| 1241591 | 6/1967 | Fed. Rep. of Germany | 4/171 |

*Primary Examiner*—Henry K. Artis
*Attorney, Agent, or Firm*—Robert K. Youtie

[57] ABSTRACT

A buoyant sectional deck for surrounding a swimming area, perforate side plates depending from the deck and defining a side wall, perforate bottom plates extending across the lower region of the side wall to define the bottom wall, and means securing together the bottom and side plates with the latter secured to the deck sections.

5 Claims, 5 Drawing Figures

FIG. 1
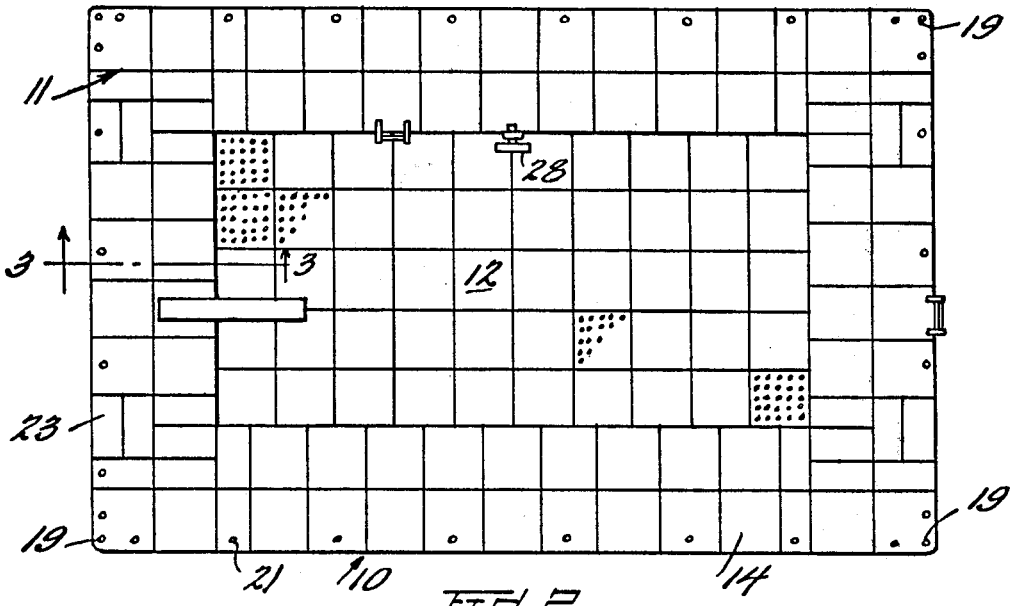
FIG. 2
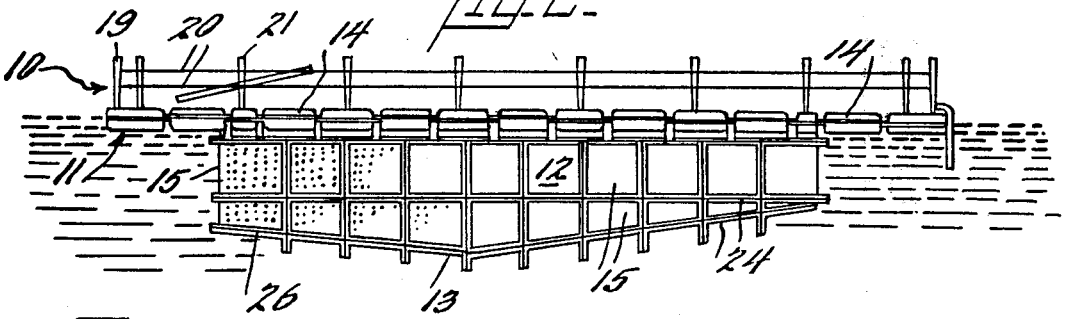
FIG. 3
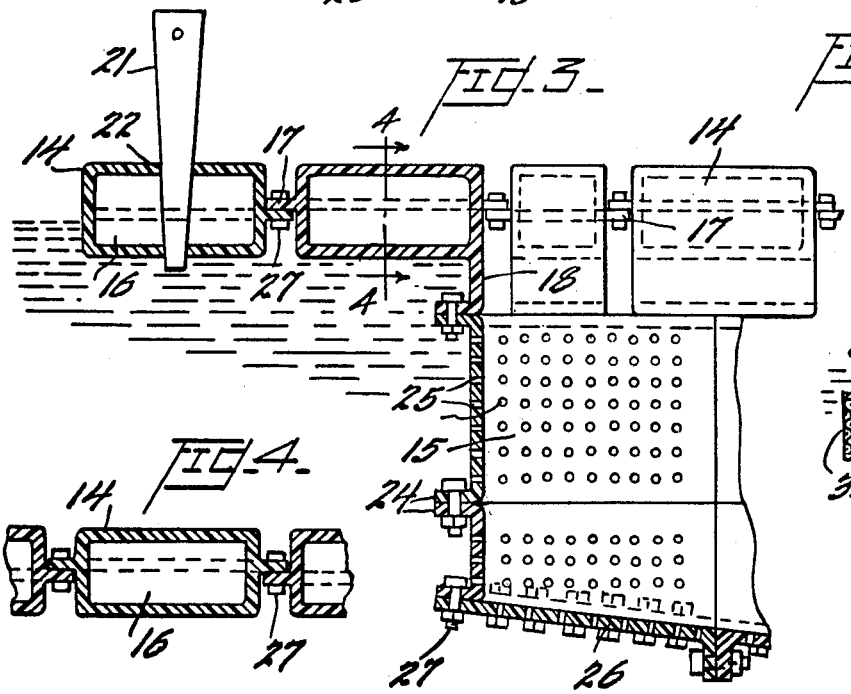
FIG. 4
FIG. 5
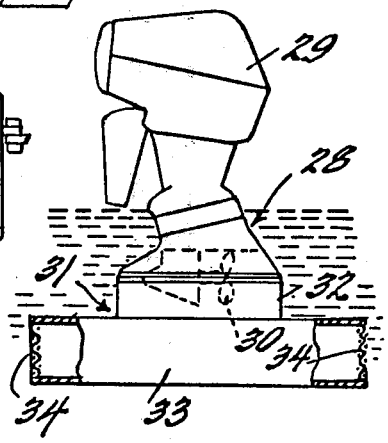

FLOATING SWIMMING POOL

BACKGROUND OF THE INVENTION

Pools adapted to be moored in a body of water, such as a lake, stream or ocean, are known, the purpose of such pools being to protect swimmers from aquatic life or debris which may be present in the area, or to enable bathing in areas which are otherwise unsuitable due to various adverse conditions such as muddy, rocky or silty bottoms or the presence of dangerous currents. This is especially true of tidal salt waters such as bays, harbors, inlets, channels or marina where ebb and tidal flow prevail, in that dangerous currents and/or poor bottom conditions may prevent the bather from utilizing these otherwise beneficial bodies of salt water. Thus, the purpose of these pools is to allow the bather to take advantage of these otherwise unsuitable natural waterways together with more favorable natural conditions.

These known pools suffer from two disadvantages, namely, the difficulty of construction and disassembly or the absence of a bottom which will provide firm footing for the bather.

SUMMARY OF THE INVENTION

In accordance with the present invention, these difficulties are overcome by providing a floating swimming pool comprising a peripheral pool-enclosing deck composed of a plurality of secured together buoyant sections having a substantially flat upper surface. These buoyant sections are positioned in rows, the deck being constituted by the secured together buoyant sections. These sections are releasably secured together to facilitate assembly, disassembly and storage. The sides and bottom of the pool are formed of a plurality of perforated plates releasably secured together. The upermost plates which form the pool sides are releasably secured to the buoyant sections constituting the deck. The secured together plates forming the pool bottom are rigidly interconnected, thereby providing a relatively rigid bottom for improved footing.

Thus an object of this invention is the provision of a pool structure which is easily fabricated, transported and erected. The entire pool and decking is comprised of modular panels, similar in size and construction for easy assembly. Conversely the structure is easily dismantled and stored. Both these operations may be accomplished by one man.

The relatively rigidly interconnected plates and buoyant sections provide a pool which can be assembled or disassembled and stored with relative ease while providing a pool of any desired size and having a generally rigid construction including a rigid bottom for improved footing, thus overcoming the difficulties of prior known floating pools.

The perforated plates are rigid plates, preferably made of relatively rigid plastic for light weight utilizing a monolithic form of construction for increased rigidity and load bearing capacity. These plates are also preferably formed on a module basis to minimize the number of differently formed plates which are needed. Thus, most of the plates would be of the same size and shape, e.g., rectangular, and some of the plates would have one sloping side to provide a tapered bottom for the pool. The plates are suitably interconnected by the use of nuts and bolts and other fastening devices which join together mating flanges of adjacent plates. The flanges are preferably formed integrally on all four edges of each of the plates to provide enhanced strength and the plates are desirably positioned with the flanges extending outwardly of the pool.

The perforated plates are provided with a plurality of apertures or perforations in such size and number as to not substantially weaken the load bearing capacity of the plates while allowing water in the pool to be constantly circulated and replenished with fresh water either by the natural flow of water in the vicinity of the pool or by the use of a circulatory device such as an outboard motor in areas of static water circulations such as may exist in a lake, or other similar bodies of water.

The use of relatively small perforations in the plates allow the plates to remain rigid, and also allows water circulation therethrough while providing comfortable footing for the bathers.

The buoyant sections are desirably of one piece molded construction block-like in shape, preferably rectangular, and formed to include a sealed hollow air-pocket therein, but the invention is not to be limited to any particular buoyancy expedient. Many of these buoyant sections are secured together to allow ease of assembly or disassembly of the deck or storage of these parts. Also an advantage of using hollow block buoyant sections is that such sections provide increased load bearing capacity for the deck. The hollow-block buoyant sections have a generally flat upper surface for deck use and flange members around the lower periphery thereof to allow these sections to be secured to each other in rows to form a deck for the pool.

If desired, some of these buoyant sections can be joined together in a solid structure to form a raft or dock, which is preferably rectangular but may also be circular or "U" shaped if desired.

To facilitate discussion, the following specific consideration of the present invention is directed to the preferred form of pool structure, namely, a pool of rectangular shape, and to the utilization of rectangular buoyant sections to facilitate construction thereof. However, the present invention is in no way limited to the use of a rectangular pool shape since the present invention may be used to form pools of various geometrical shapes.

Further, the present invention is not limited to the use of rectangular buoyant sections since buoyant sections having circular or polygonal shapes may be used to facilitate construction of pools of geometrical shapes other than rectangular.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a diagrammatic plan view of the swimming pool formed in accordance with the present invention.

FIG. 2 is a side view of the pool of FIG. 1.

FIG. 3 is a vertical sectional view taken along line 3—3 of FIG. 1.

FIG. 4 is a partial vertical section taken along line 4—4 of FIG. 3 showing detailed construction of the hollow buoyant sections.

FIG. 5 shows another aspect of the present invention, namely, a water circulation device for the pool of the present invention.

DESCRIPTION OF THE PREFERRED EMBODIMENT

Referring more particularly to FIGS. 1 and 2, swimming pool 10 is defined by the rectangular buoyant deck 11 and the body of the pool 12 formed to include a generally sloping bottom 13. The pool is provided with the usual appurtenances to a pool such as ladders, diving board, etc. As can be seen generally in FIG. 2, the swimming pool of the present invention is formed by securing together buoyant sections 14 to form the floating deck 11 and by securing to the deck perforated plates 15 which form the body of the pool 12.

The buoyant sections 14 are blocklike in shape as can be seen in FIGS. 1 and 2. Referring to FIG. 3, the buoyant sections 14 are formed to include a sealed hollow air space 16 therein to effect the buoyancy of the section 14. These sections are desirably formed of substantially rigid plastic material resistant to chemical degradation and may be made by molding the plastic in a single operation by methods well known to the art.

The buoyant sections 14 are also formed to include a securing flange 17 which is positioned on the periphery of the section 14, and which allows the buoyant sections 14 to be secured together to form the deck. While any flange element which accomplishes the above stated function may be used, for simplicity of manufacture and assembly, the flange has one face in the same plane as the center line of the buoyant section. Thus, by rotating one section 180° with respect to another section about an axis parallel to the flanges, the flanges of the two sections will be positioned one on top of the other, thereby providing, by securement of the two sections, a flat deck surface without the necessity of providing two different buoyant sections having mating flanges.

If desired, buoyant sections 14 may be formed to omit the flange element on the outer periphery of the outer buoyant sections though this is not necessary. Also the inner buoyant sections may be formed to include on the inner surface thereof a pool connecting flange or some other mechanical fastening means 18 though this expedient is not a requirement of the present invention.

The outer row of buoyant sections are also desirably formed to include mooring means for mooring the pool in a body of water generally indicated at 19 and means for attaching safety ropes 20. These means may be molded into the buoyant sections or attached in any other desirable manner. Preferably, the safety ropes are attached to posts 21 which are of tapered form corresponding to a tapered hole 22 formed in the outer buoyant section as can be seen in FIG. 3, to provide a wedging action.

To further increase the rigidity and load bearing capacity of the deck 11, half size buoyant sections 23 are preferably provided in the corners of the deck which are so arranged that the longitudinal flanged edges of the half sections of the outer row of buoyant sections are perpendicular to the longitudinal flanged edges of the half sections of the inner row. This expedient provides at the juncture of the pool 12 and the deck 11 an increased load bearing capacity of the deck 11.

The bottom and sides of pool 12 are formed by securing together perforated plates 15 which are formed to include securing flanges 24 which extend outwardly of the pool to thereby provide a smooth inner pool surface. These flanges increase the rigidity and load bearing of the plates. The plates 15 are also provided with perforations 25 which allow free circulation of water into the pool to thereby avoid the possibility of the water in the pool becoming stagnant. These perforations are of relatively small size and are arranged in rows so that the load bearing capacity of the plate is not significantly reduced. The upper row of plates forming the pool sides and the plates forming the bottom of the pool are preferably rectangular in shape and of one size to reduce the number of parts needed to construct the pool. The upper row of plates securing flange 18 as described hereinbefore.

In order to provide sloping bottom 13 of the pool, the lower row of said plates are trapezoid in form having three sides at right angles to one another with a sloping surface 26 at the lower edge thereof. The size of these sloping plates are varied so as to provide a sloping bottom which is desirable when the pool is to be used both by small children and adults especially when it is desired to utilize a diving board.

These sloping plates may be conveniently formed by molding relatively rigid plastic material in an adjustable mold. Similarly, the other perforated plates may also be conveniently formed by molding preferably utilizing a relatively rigid plastic material.

The plates 15 and also the buoyant sections 14 are secured together by any convenient securing means such as by nuts and bolts 27. Preferably, plastic nuts and bolts (including plastic coated nuts and bolts) are desirably used so as to prevent freezing of the nuts to the bolts or deterioration thereof due to the chemical action of water and/or salt on the metal.

When the pool is moored in a static body of water such as a lake, the flow of water through the pool is reduced to an undesirable minimum and therefore, means to increase the flow of water through the pool are provided as indicated by 28 in FIG. 1. Any means which will provide the water circulation function are contemplated, such as, gasoline motor or electric motor powered circulatory pumps. Preferably, the circulatory action is provided by a gasoline fueled outboard motor 29 as can be seen in FIG. 5. In order to prevent damage to the motor by debris and injury to the users of the pool, the propeller 30 is desirably encased in a protective T-type duct 31 which not only provides the desired protection but also improves the circulatory flow of water.

The duct is composed of a propeller encasing portion 32 and a water flow section 33 in the shape of an elongated rectangular or circular tube open at both ends. These ends are provided with a protective screening 34 of either metal or plastic to prevent the flow of debris into the duct and also to prevent possible injury to inquisitive children.

By utilizing a T-duct, the rotary movement of the propeller causes an increased flow of water through the duct thus providing a more efficient circulatory device.

From the foregoing it can be seen that the present invention provides a floating pool structure which is easy to construct and which provides the features of the normal swimming pool. It will be understood that various ancillary equipment such as lights and power source or electrical connection means therefor, will also be present and the showing of such ancillary equipment has been minimized herein for clarity. It will also now be appreciated that the instant invention, by its unique air-filled hollow bodies provides a highly rigid, lightweight, noncorrosive, easily erected and dismantled deck, while the perforate plates enhance the rigidity, are also light in weight and noncorrosive. For additional lightness the side and bottom wall panels or plates 15 may be fabricated of plastic foam, or the like.

Although the present invention has been described in some detail by way of illustration and example for purposes of clarity of understanding, it is understood that certain changes and modifications may be made within the spirit of the invention.

What is claimed is:

1. A floating swimming pool comprising a plurality of buoyant sections each having flat upper and lower surfaces and arranged in horizontally coplanar adjacent side-by-side relation about a closed outline configuration, a laterally outstanding flange on each of said sections with the flanges of adjacent sections offset vertically from and in overlying relation with each other for securement together of any two adjacent sections with their flanges overlapping, securing means releasably securing together overlapping flanges of adjacent buoyant sections, a plurality of perforate side plates arranged in edge-to-edge relation with each other and depending from said buoyant sections to define an encompassing side wall, a plurality of perforate bottom plates arranged in edge-to-edge relation with each other and extending between the lower edges of said side wall to define a bottom wall, and additional securing means detachably securing together said bottom and side plates and detachably securing the latter to said buoyant sections.

2. A floating swimming pool according to claim 1, said buoyant sections each comprising a hollow air-filled block-like member with said outstanding flanges having one surface generally on the horizontal center line for overlapping flange engagement with a like inverted section.

3. A floating swimming pool according to claim 2, said additional securing means comprising a depending flange on the inner side of each buoyant section for connection to said side plates.

4. A floating swimming pool according to claim 3, said depending flanges comprising integral extensions on said sections.

5. A floating swimming pool according to claim 1, in combination with an outboard motor mounted on said buoyant sections and having a propeller depending into the space encompassed by said side wall for emersion in water, and a hollow open ended duct enclosing said propeller, said duct serving to guard the occupants from injury while aiding in the circulation of liquid.

* * * * *